US006571396B1

(12) United States Patent
Yan

(10) Patent No.: US 6,571,396 B1
(45) Date of Patent: Jun. 3, 2003

(54) STRETCH BAND CONSTRUCTION FOR CAPS

(76) Inventor: Seun Ching Yan, 17145 Margay Ave., Carson, CA (US) 90746

( * ) Notice: Subject to any disclaimer, the term of this patent is extended or adjusted under 35 U.S.C. 154(b) by 0 days.

(21) Appl. No.: 10/318,456

(22) Filed: Dec. 12, 2002

(51) Int. Cl.[7] ..... A41D 19/00
(52) U.S. Cl. ..... 2/195.1; 2/181.2
(58) Field of Search ..... 2/195.1, 181.2, 2/181, 195.3, 181.4, 183, 195.2; 112/78; 442/182; 450/123

(56) References Cited

U.S. PATENT DOCUMENTS

| | | | | |
|---|---|---|---|---|
| 2,196,808 A | * | 4/1940 | Hawley, Jr. | 154/2 |
| 2,343,155 A | | 2/1944 | Paul | 2/195 |
| 2,810,913 A | | 10/1957 | Kennedy | 2/195 |
| 5,615,415 A | | 4/1997 | Beckerman | 2/195.3 |
| 5,715,540 A | | 2/1998 | Cho | 2/195.3 |
| 5,765,229 A | | 6/1998 | McLeod et al. | 2/195.1 |
| 5,822,799 A | * | 10/1998 | Kepple | 2/183 |
| 5,926,850 A | | 7/1999 | Han | 2/183 |
| 5,966,742 A | | 10/1999 | Cunliffe | 2/195.3 |
| 5,983,398 A | | 11/1999 | Kronenberger | 2/181 |
| 6,119,273 A | | 9/2000 | Cho | 2/195.3 |
| 6,131,202 A | | 10/2000 | Yan | 2/195.3 |
| 6,477,715 B2 | * | 11/2002 | Shin | 2/181.4 |
| 6,499,144 B1 | * | 12/2002 | Yan | 2/181.2 |

OTHER PUBLICATIONS

U.S. patent application Publication, US 2002/0129438 A1. Published Sep. 18, 2002, filed Jan. 12, 2001, inventor: Siegel, title: Size Adjustable Sports Cap.

* cited by examiner

*Primary Examiner*—John Calvert
*Assistant Examiner*—Katherine Moran
(74) *Attorney, Agent, or Firm*—Cislo & Thomas LLP

(57) ABSTRACT

A stretch band construction for caps or hats includes an additional folded-over layer of stretchable material that serves to reinforce and support the cap or hat. Circumscribing the open end of the cap, the stretch band construction provides additional elastic support so that a cap may more firmly and tightly engage a mandrel used during an embroidery process. This leads to more reliable embroidery and less thread breakage to the cap. The stretch band has a ribbed portion which allows the stretch band to be doubled back and secured to the cap material.

14 Claims, 2 Drawing Sheets

STRETCH BAND CONSTRUCTION FOR CAPS

CROSS-REFERENCES TO RELATED APPLICATIONS

This patent application is related to U.S. patent application Ser. No. 10/242,379 filed Sep. 10, 2002, U.S. Pat. No. 6,499,144 entitled Three Component Elastic Band which application is incorporated herein by this reference thereto.

BACKGROUND OF THE INVENTION

1. Field of the Invention

This invention relates to hat and cap making, and more particularly to a stretch band configuration in manufacturing that enables better engagement of the sewn cap, as well as more resilient construction of the internal hat band which allows for embroidering of the cap or hat without breaking the stitching.

2. Description of the Related Art

Elastic bands, particularly elastic sweatbands, have been used in conjunction with hats, including baseball caps, to provide a sizable fit on a wide variety of head sizes as well as providing protection from sweat rolling into the eyes and onto the face of the cap wearer. Baseball caps often have a front bill which serves to shade the wearer's eyes and are often used in conjunction with sporting and athletic events. Sporting and athletic events obviously include baseball, but can also include running, bicycling, volleyball, hiking, and the like. The baseball cap has certainly become a standard item to such an extent that it is used as a promotional item and favor and is often offered under the moniker of "gimme" cap.

Particularly with regard to baseball caps and other promotional billed caps, stitching or embroidery is often provided on the front of the cap that indicates a favorite athletic team, advertising, or other logo or embroidery. Such embroidery, or stitching, is often used to decorate the cap and make it more appealing to the wearer or possible purchaser.

In order to apply the stitching or embroidery to the front fabric of the cap, the cap is often held by a mandrel (also called an embroidery horn or tool) or other device such that a stitching, sewing, or embroidering machine can then apply the colored thread or other material to effect the embroidery. The elastic nature of the cap or any hat band it bears may often serve to hold the cap on the mandrel. In fitting the cap on the mandrel, some stretching of the cap occurs, generally at the same location where a person's head would fit into the cap. Due to the mechanized nature of this process, some stitch damage may occur to the cap and/or the internal sweat band, and the elasticity and comfort fit of both may be affected. Consequently, a need has arisen in the art in order to find a way by which stretch fit caps and the like can better endure or withstand the mandrel and stitching processes in order to provide a better ultimate product for people, consumers, or users.

When the cap is stretched over the mandrel, some bursting or breaking of the threads can occur, which reduces the secure retention of the sweat band or stretch band circumscribing the interior of the cap. This can lead to a poor fit or a shortened useful life, and may prevent people from getting the full enjoyment out of the cap they have obtained or purchased. Additionally, when such thread breakage occurs when the cap is fitted on the mandrel, some shifting or movement can occur by the cap on the mandrel. When the cap moves during the stitching process, the resulting embroidery may have flaws or errors that may detract significantly from the desired result.

Consequently, there is a need in the art for stable positioning of caps on mandrels as the embroidery process has become one of significant concern. The present invention provides a means by which not only can caps better withstand the embroidery process with the accompanying stress from the mandrel, but the resulting embroidery can be of higher quality and of more reliable result, with fewer rejects arising from flawed stitching. Further, even where the cap or hat is not embroidered, a better securement between sweat band or elastic band and upper cap or hat portion is obtained.

Certain approaches to elastic bands for headwear are known in the art. These include:

U.S. Pat. No. 2,343,155 relates to a work hat, particularly to be worn by women in the workplace, to confine their hair wherein the cap has a stiff front crown portion, a loose top and an adjustable back which permit the enclosure of the wearer's hair, and as such.

U.S. Pat. No. 2,810,913 is directed to a head covering which is of two-ply construction with free lower edges, wherein each ply has pervious and impervious portions, with one of the portions being elastic and wherein the impervious portions of the plies are offset to provide a means of restricting the passage of air through.

U.S. Pat. No. 5,615,415 relates to a custom fit cap wherein the crown portion opposite the visor of the cap is made of circumferentially stretchable material as is the band that is attached to the inside of the cap, which allows the cap to stretch circumferentially in conjunction with the crown portion so as to fit a plurality of head sizes.

U.S. Pat. No. 5,715,540 pertains to a free size cap wherein the crown portion is made up of gores whereas one of the gores is uniaxially stretchable and being capable of being stretched along the chordial axis of the multi-gore shell. There is a sweat band of a single unfolded sheet as best seen in FIGS. 9, 10, and 11 of the patent.

U.S. Pat. No. 5,765,229 is directed to a sun visor head gear employing a chin strap wherein the band and front bill of the headgear are integral and made of a one-piece structure.

U.S. Pat. No. 5,926,850 relates to an improved fit cap wherein the sweatband has a bottom edge and a top edge and is attached along its lower edge to an interior surface of the crown member and wherein the sweat band is of a larger circumference along its bottom edge than at its top edge and the construction is best seen in FIGS. 3 and 4 of the patent U.S. Pat. No. 5,966,742 relates to an adjustable cap that uses a peripheral band, wherein a two part peripheral band, not having a folded-over edge, is utilized not as contemplated in the instant application.

U.S. Pat. No. 5,983,398 relates to a headwear piece such as a cap which make up the cap as best seen in FIGS. 6, 7, and 8 of the patent.

U.S. Pat. No. 6,119,273 relates to a free-size cap wherein the sweat band is made of a stretchable woven fabric of a specific construction U.S. Pat. No. 6,131,202 is directed to a cap having a multi-axially stretchable fabric wherein the inner foam circumferential member that is adhered to the lower peripheral portion of the cap by means of stretchable thread.

U.S. Patent Application Publication No. US 2002/0129438 A1 pertains to an adjustable sports cap having a circumferential band which is made up of both stretchable and unstretchable sections as best seen in FIGS. 3, 4, and 5 of the publication.

SUMMARY OF THE INVENTION

In view of the foregoing disadvantages inherent in the known types of caps and stitching systems now present in the prior art, the present invention provides new means by which hats or caps may be held more stably upon mandrels during the stitching process, suffer less breakage or damage when fitted on such mandrels, and may be stitched or embroidered more reliably.

The general purpose of the stretch band construction set forth herein, which will be described subsequently in greater detail, is to provide a new stretch band construction which has many of the advantages of prior stretch bands and elastic bands for caps and the like, and many novel features that result in a new stretch band construction which is not anticipated, rendered obvious, suggested, taught, or even implied by any of the prior art stretch band constructions, either alone or taken in any combination thereof.

The stretch band construction set forth herein uses a reinforcing fold, along one edge at which point the stretch band is attached to the hat or cap's bottom edge, in order to provide additional reinforcement and additional elasticity to the hat or cap band. Particularly for baseball caps or other similar hats, the stretch band construction set forth herein enables the use of any chosen type of sweatband or prior elastic band used for such hats. The additional lengthwise fold extension is then part of the band. The fold extension area provides a separate band area which is thinner in thickness than the remainder of the band and may be formed by ribbing or the like. When the band is attached to the hat or cap, the thinner stretch band portion is then folded over to provide a double layer of elastic material coincident to the interior of the bottom edge of the hat or cap at which the head enters the crown, or inside, of the cap. This doubling of the elastic material provides additional support for the band and cap which also provides additional support and distribution of pressure when the hat or cap is mounted onto a mandrel. The additional stretch band material associated with the sweat band and cap edge provides stronger construction as well as better results in both the stitching process and in the wearing of the hat or cap.

OBJECTS OF THE INVENTION

It is an object of the present invention to provide a system that enables better embroidery of caps.

It is another object of the present invention to provide a system that reduces the injury to caps when they are embroidered.

It is yet another object of the present invention to provide a system that reduces damage to caps when they are fitted on mandrels, especially for a stitching process.

It is yet another object of the present invention to provide a new stretch band construction that accomplishes the foregoing objects.

It is yet another object of the present invention to employ a stretch band construction that can be associated with previously known bands in order to achieve better cap construction and processing.

It is yet another object of the invention to provide a stretch or sweat band of specific construction for utilization with hats or caps that employs a folded edge portion to provide more secure retention of the band with the main portion of the hat or cap with which it is used.

These and other objects and advantages of the present invention will be apparent from a review of the following specification and accompanying drawings.

DESCRIPTION OF THE PREFERRED EMBODIMENT(S)

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figure 1:
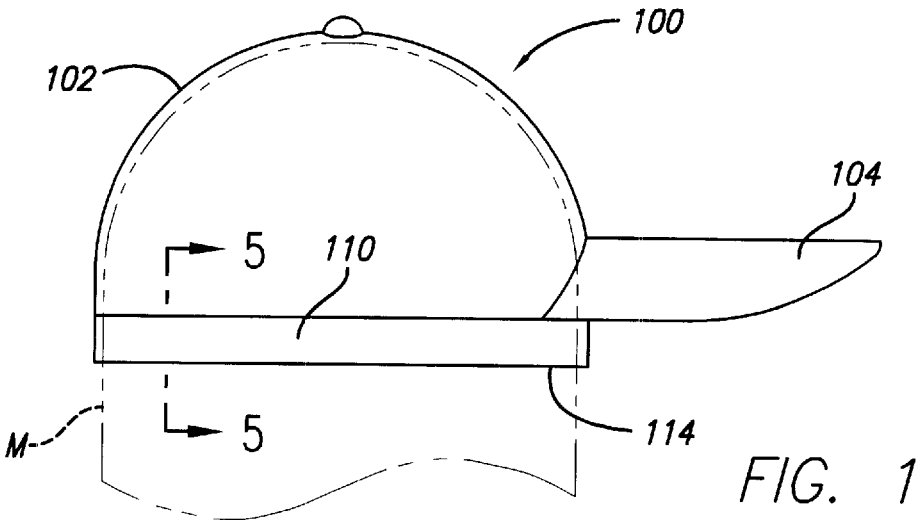
FIG. 1 is a right partial cutaway view of a ball cap incorporating the stretch band construction set forth herein with a mandrel being shown in phantom line.

Referring to the drawings where like numerals of reference designate like elements throughout it will be noted that FIG. 1 shows a hat, or cap, 100 having a bowl, or crown, 102 and a bill 104. FIG. 1 generally shows a baseball cap as is known in the art and commonly used for generally a variety of athletic and casual activities but showing the inventive interior hat band 110. The crown 102 serves to cover the person's head and the bill 104 serves to shade the person's eyes when the cap 100 is worn.

Shown in partial view is the interior hat band 110. Such hat bands are connected or stitched to the depending crown portion 103 (FIG. 4) of cap 100 on the interior side thereof near the lower edge, generally where the head enters the crown 102. Such interior hat bands 110 are usually elastic in nature and may supplement any elasticity in the edge 112 (FIG. 4) of the open end 114 of the cap 100. Alternatively, the interior hat band 110 may be the sole source of such elasticity and serve to contract the fabric of the cap 102 around the head of the wearer. An example of one such hat band is disclosed in the previously-filed U.S. patent application Ser. No. 10/242,379 filed Sep. 10, 2002 entitled Three Component Elastic Band which is incorporated herein by this reference. Other elastic hat bands in the art have been commonly used for some time and may have the inventive construction incorporated therein to achieve the desired end results.

Figure 2:
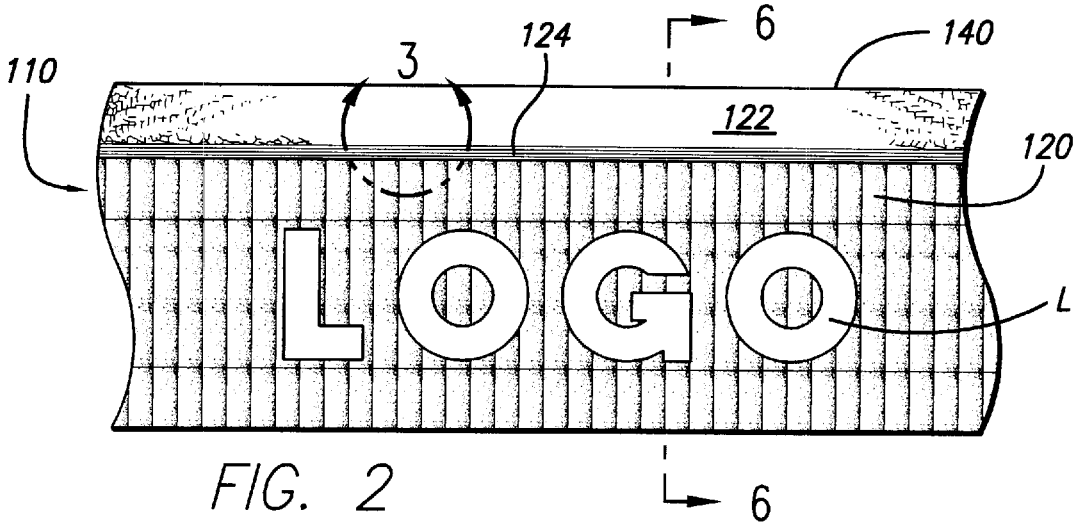
FIG. 2 is a plan view of the stretch band/sweat band configuration in a preferred embodiment of the present invention.
Figure 3:
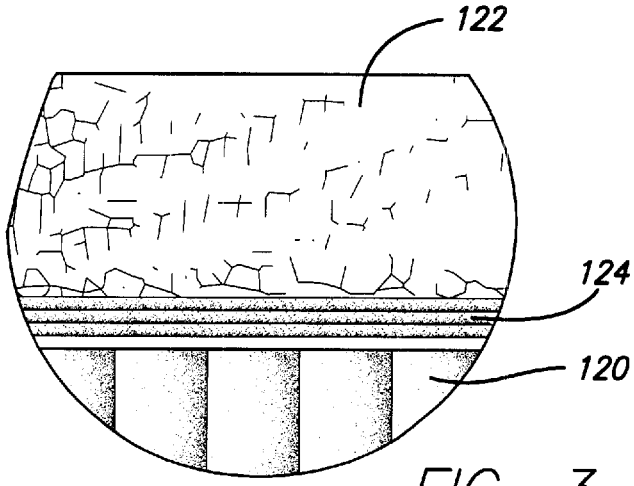
FIG. 3 is an enlarged view of the stretch band construction taken along circle 3 of FIG. 2.

In FIGS. 2 and 3, the varying components and elements of the stretch band construction of the interior hat band 110 are shown in greater detail. The lower sweat band portion (as seen in FIG. 2) is generally one that is known in the art as indicated by the above-mentioned patent application. Alternative sweat bands may also be used. The sweat band 120 shown in FIG. 2 provides a first band portion to the interior hat band 110 and may include a logo L that may be stitched into or made a part of the sweat band portion 120. As shown in FIG. 2, the logo L is viewed by the reader or viewer in a right side up configuration. In practice, the logo L may be sewn or weaved into the first band portion 120 upside down so that it is right side up when the first band portion 120 is folded into the interior of the crown 102.

Stretch band 122 provides a second band portion to the interior head band 110. The second band portion 122 is connected to the first band portion 120 by means of a longitudinally ribbed portion 124. The entire interior head band 110 is shown in cross-section in FIG. 6, where it can be seen that the second band portion 122 and the longitudinally ribbed portion 124 may be significantly thinner than that of the first band portion 120.

FIG. 3 shows a close-up of the three band portions as taken along circle 3 of FIG. 2. The longitudinally ribbed portion 124 is distinctly shown dividing the first and second band portions 120, 122. As described in more detail below, the ribbed portion 124 enables easier folding of the interior head band 110 so that the second band portion 122 may be folded back upon first band portion 120.

Figure 4:
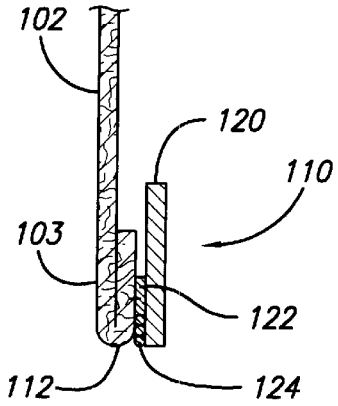
FIG. 4 is a cross-sectional view of the stretch band construction of the present invention showing the cap folded over a lower end and attached to the folded-over stretch band construction and stitched thereto.
Figure 5:
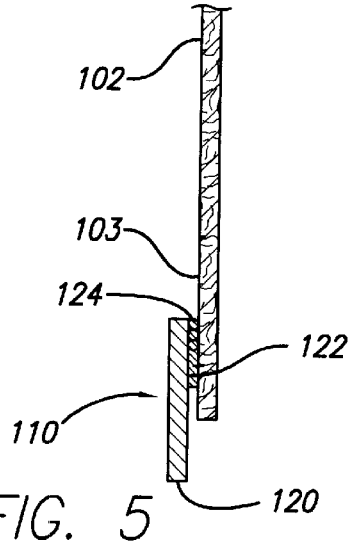
FIG. 5 is a cross-sectional view of the stretch band construction taken along line 5—5 of FIG. 1 with stitching.

In FIGS. 4 and 5, the interior hat band 110 is attached to the crown 102 at the depending crown portion 103 by stitching or the like. In FIG. 4, the interior hat band 110 is folded over at the ribbing 124 to provide a double-backed area where stitching may be made through one or more layers of crown fabric material. In some embodiments, the edge 112 of the crown 102 is created by folding part of the crown fabric interiorly and back upon the crown 102. This is shown in FIG. 4 and the edge 112 is often maintained by intermittent stitches coincident with the seams between each of the gores, or panels, often present in the crowns 102 of baseball caps such as the one indicated by reference number 100.

In FIG. 4, a cross-sectional view of the stretch band construction of the present invention shows how the same is attached by stitching to the depending crown portion 103. The interior hat band 110 has a first band portion 120 connected to a second band portion 122, the two being connected by a series of intermediate longitudinal ribs forming a rib portion 124. FIG. 3 shows the interior hat band 110 construction when laid out flat.

As shown in FIG. 4, the interior hat band 110 and more specifically the first band portion 120 provides that portion of the interior hat band 110 that interfaces with depending crown portion 103 of crown 102 and is generally the part which engages the wearer's head. The second band portion 122 is folded over at the edge as seen in FIG. 4, which is then stitched to depending crown portion 103. As noted, longitudinal rib portion 124 is intermediate the first and second band portions 120, 122.

Manufacturing considerations, convenience, and assembly requirements generally dictate that the combination and association of the three components making up interior hat band 110 with depending crown portion 103 provides a significant advantage. The provision of the ribbed portion 124 allows for ease of folding over of the interior hat band 110 for easy attachment as best seen in FIG. 4. The interior hat band 110 generally runs along the cap's interior lower edge 112 to the same extent of the circumference thereof.

Figure 6:
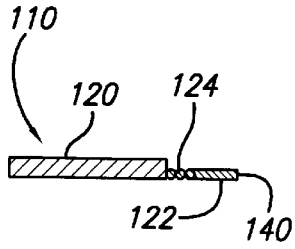
FIG. 6 is a cross-sectional view of the stretch band/sweat band configuration of FIG. 2, taken along line 6—6 thereof.

The second band portion 122 may have a height that is significantly less than that of the first band portion 120 (FIG. 6). Stitching may be used to attach the interior hat band 110 to the depending crown portion 103 of crown 102. Such stitching may pass through the interior hat band 110 at the folded-over portion, as shown in FIG. 4, generally adjacent the center of the ribbed band portion 124 of the interior hat band 110 in a preferred embodiment.

Figure 7:
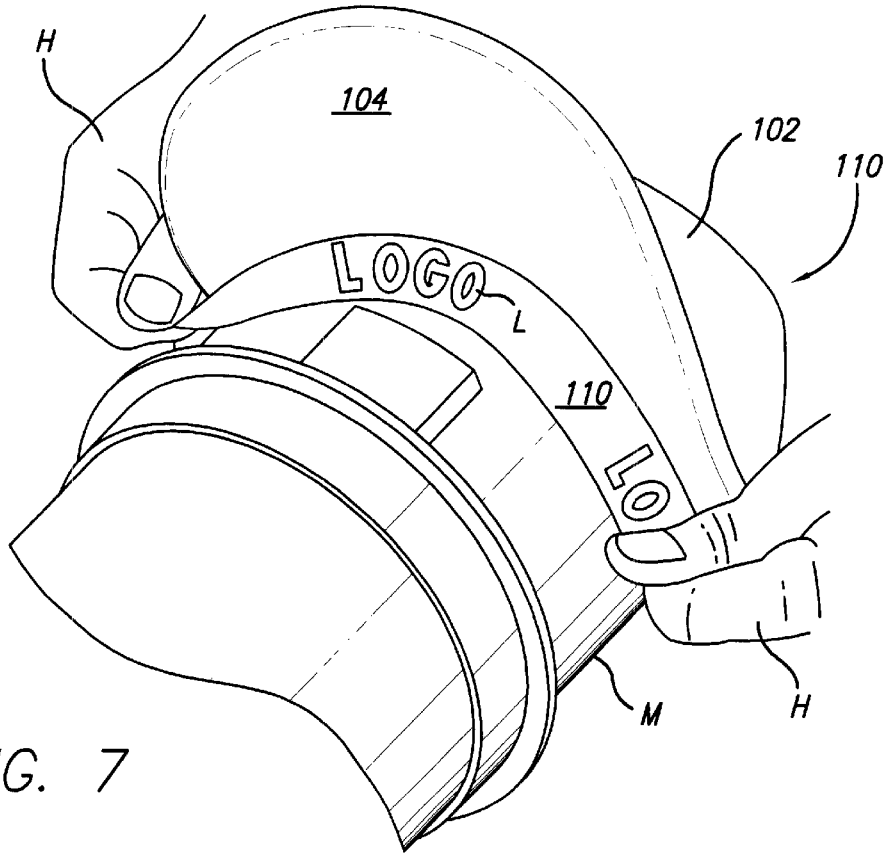
FIG. 7 is a pictorial representation illustrating how a cap with the stretch band construction of the present invention is fitted on an embroidery horn, or mandrel, in preparation for embroidering.

The longitudinal ribs 124 allow for folding between the first band portion 120 and the second band portion 122 and may be of the same or similar material. The overall construction of the band 110 may be altered in order to achieve better or specific stretchability in order to better achieve the ends of the manufacturer, just so long as the longitudinal rib portion 124 is provided. The ribs may allow for folding over the edge of the band 110 so that stretching on a mandrel M of at least 15% is obtained in order to provide a tight stretch over the mandrel M to better hold the cap in place during the stitching process and as to not break the stitching securing the band 110 to the cap 100.

Where only one layer of the crown fabric is attached to the double-backed interior hat band 110, the hat band 110 may be folded out from the interior of the cap 100 as shown in FIG. 5. As shown in FIGS. 5 and 7, this enables the cap 100, particularly the front of the crown 102, to be stitched with embroidery or designs without also stitching the interior hat band 110 to the crown 102 during the embroidery process. As shown in FIG. 7, the interior hat band 110 with its optional logo L is moved out of the way when mandrel M is inserted into the crown 102. This is generally a manual process as indicated by the hands H manually placing the hat 100 with the out folded interior hat band 110 onto the mandrel M.

Once the embroidery process is finished, the hat 100 may also be manually removed from the mandrel M or embroidery horn. The interior hat band 110 is then folded back into the interior of the crown 102 such that the crown and hat band are arranged as shown in the cross-sectional view of FIG. 4.

In one embodiment, the band 110 may be 100% rayon, although a preferred embodiment has rayon as a 30% constituent thereof. Spandex may be used in the second band portion 122 and the interior hat band 110 may stretch in three directions in order to better operate under the circumstances encountered during the stitching process (FIG. 7) with its mandrel M and when worn. Polyester may also be used to good effect in the band 110. The edge 140 of the second band portion 122 may have sufficient spandex content to stretch at least 50% and preferably in the range of 50 to 100%. Other nylon, polyester or synthetic fabrics may also be used in the second band portion 122. Additionally, polyester fibers may be used in order to provide some elasticity to the band 110 and second band portion 122.

Further, as those of ordinary skill will recognize, the interior hat band 110 may overlie a cushioning layer or may underlie an absorbent layer without defeating the intended end function of the inventive band 110. The band 110 is usually folded inside the cap 100 but may have spaced thread tacks to ensure its securement to the interior circumference of the cap 100.

By providing the folded over edge band 110 as set forth, embroidery of the cap 100 at either the front, back, or otherwise, may be achieved as there is a tighter and better engagement between the cap and the mandrel M without fear of breaking any of the stitches in the area of the mandrel M.

The cap 100 may be made of fabric that is not stretchable, stretchable in one direction only (uniaxial), or stretchable in a multiple number of directions (multiaxial).

By implementing the stretch band construction set forth herein, manufacturers can achieve better and more reliable embroidering of caps as well as better securing and maintaining the integrity of the elastic portions of the cap 100, generally those portions which are the first to suffer fatigue.

While the present invention has been described with regards to particular embodiments, it is recognized that additional variations of the present invention may be devised without departing from the inventive concept. For example, the thinner in cross section ribbed portion 124 may be obtained using other than a ribbed construction.

EXAMPLE

A band 110 of the present invention was fabricated using the following characteristics:

| | Thickness | Width | Material of Construction |
|---|---|---|---|
| First band portion | 2 mm | 1.2" or 30 mm | See below |
| Second band portion | 1 mm | 6–6.5 mm | 20% or more spandex |
| Ribbed portion Stitching | 0.5 mm | 0.5 mm | 50% or more spandex |

The tables below indicate by row percentage compositions of polyester, cotton and rubber spandex for each row for a preferred embodiment of a first band portion 120 having three rows (such as one disclosed in U.S. patent application Ser. No. 10/242,379 filed Sep. 10, 2002 entitled Three Component Elastic Band).

| | Polyester | Cotton | Rubber Spandex | Total |
|---|---|---|---|---|
| Outer Row | 43.927% | 25.715% | 30.358% | 100% |
| Middle Row | 49.698% | 29.089% | 21.213% | 100% |
| Outer Row | 43.927% | 25.715% | 30.358% | 100% |

Below in tabular form are percentage components as a percentage of the whole of such an embodiment of the three-component band used as a first band portion 120.

| | Polyester | Cotton | Rubber Spandex | Thickness |
|---|---|---|---|---|
| Outer Row | 13.820% | 8.090% | 9.550% | 2.3 mm |
| Middle Row | 18.428% | 10.786% | 7.866% | 2.0 mm |
| Outer Row | 13.820% | 8.090% | 9.550% | 2.3 mm |
| Total | 46.068% | 26.966% | 26.966% | 100% |

Below in tabular form is the percentage of rubber spandex of the whole for each row of such an embodiment of the three-component band used as a first band portion 120.

| | | % Rubber Spandex |
|---|---|---|
| Outer Row | Diameter of Rubber Spandex - 0.6047 mm Total 7 pcs. | 35.415% |
| Middle Row | Diameter of Rubber Spandex - 0.3175 mm Total 14 pcs. | 29.170% |
| Outer Row | Diameter of Rubber Spandex - 0.6047 mm Total 7 pcs. | 35.415% |
| | | 100% |

What is claimed is:

1. A stretch band construction for caps, comprising:

a first band portion integrally connected to a laterally adjacent second band portion having an intermediate ribbed portion which is adapted to be folded over at its edge for thread securement to the internal circumference of a cap whereby improved interconnection of said stretch band and cap is achieved.

2. A stretch band construction for caps as set forth in claim 1, wherein said stretch band further comprises:

said intermediate ribbed portion having longitudinally extending ribs extending the length of said stretch band which allow said stretch band to be folded over to provide a double layer of elastic material which provides additional support and distribution of pressure for said stretch band construction when the cap is placed over a mandrel for embroidering purposes.

3. A stretch band construction for caps as set forth in claim 1, wherein said stretch band construction further comprises:

said intermediate ribbed portion allowing for flexing thereof thereby permitting a cap to be engaged more tightly with a mandrel during the process of being stitched or embroidered upon and therefore facilitating reliable and error-reduced stitching or embroidery and reducing the frequency of damage to the cap when it is fitted upon a mandrel, especially for a stitching or embroidering process.

4. A stretch band construction for a cap, comprising:

a first band portion;

a second band portion laterally coupled to first band portion through an adjacent intermediate integral ribbed portion, said stretch band being elastic; and said stretch band being capable of being doubled over at said ribbed portion and attached to a cap.

5. A stretch band construction as set forth in claim 4, further comprising:

said stretch band being entirely of elastic material.

6. A stretch band construction as set forth in claim 4, further comprising:

said first and second band portions coupled to each other by longitudinally ribbed material making up said intermediate ribbed portion and making for easier folding of the stretch band to double over said stretch band for secure attachment to said cap.

7. A stretch band construction as set forth in claim 4, further comprising:

said stretch band being capable of being held in place with respect to said cap by stitching.

8. A band construction for a cap, comprising:

a first elastic band portion;

a second band portion laterally coupled to said first elastic band portion by an intermediate ribbed portion, said ribbed material making easier folding of the band to double over said band; and a cap said band being doubled over and attached to said cap, said band being held in place with respect to said cap by stitching; whereby said cap attached to the band may better engage a mandrel with less damage and provide better wear for a wearer of said cap.

9. A cap having an interior band construction, comprising:

a crown for engaging a person's head, said crown having an open end with a depending edge and having an interior surface adjacent said depending edge;

a stretch band at least partially circumscribing said interior surface;

said stretch band comprising a first and second portion with an intermediate ribbed portion, said stretch band being folded over at said intermediate portion and stitchingly secured to said interior surface of said cap; whereby said stretch band provides additional support and elasticity to the cap, enabling the cap to better engage an embroidery mandrel.

10. A cap as set forth in claim 9, further comprising:

said stretch band being elastic.

11. A cap as set forth in claim 10, further comprising:

said intermediate ribbed portion being more elastic than said first and second portions.

12. A cap as set forth in claim 9, further comprising:

said ribbed material having longitudinal ribs, making for easier folding of the band to double over at the edge thereof for attachment to said interior surface.

13. A cap as set forth in claim 9, further comprising:

said band being held in place with respect to said cap by stitching.

14. A cap having an elastic hat band construction, comprising:

a crown for engaging a person's head, said crown having an open end with an edge and an interior surface adjacent said edge;

an elastic stretch band at least partially circumscribing said interior surface;

said elastic stretch band comprising first and second portions laterally coupled to each other by an intermediate ribbed portion, said ribbed portion making for easier folding thereof to double over at the edge of said elastic stretch band; and said elastic stretch band being fixedly secured to said interior surface of said crown by stitching; whereby said elastic stretch band provides additional support and elasticity to said cap.

* * * * *

UNITED STATES PATENT AND TRADEMARK OFFICE

CERTIFICATE OF CORRECTION

PATENT NO. : 6,571,396 B1 
DATED : June 3, 2003
INVENTOR(S) : Suen Ching Yan

It is certified that error appears in the above-identified patent and that said Letters Patent is hereby corrected as shown below:

Title page,
Item [76], Inventor, replace "Seun Ching Yan" with -- Suen Ching Yan --.

Signed and Sealed this

Thirtieth Day of September, 2003

JAMES E. ROGAN
*Director of the United States Patent and Trademark Office*